US006694727B1

(12) United States Patent
Crawley et al.

(10) Patent No.: US 6,694,727 B1
(45) Date of Patent: Feb. 24, 2004

(54) EXHAUST PROCESSOR

(75) Inventors: Wilbur H. Crawley, Columbus, IN (US); John Nohl, Indianapolis, IN (US)

(73) Assignee: Arvin Technologies, Inc., Troy, MI (US)

( * ) Notice: Subject to any disclaimer, the term of this patent is extended or adjusted under 35 U.S.C. 154(b) by 10 days.

(21) Appl. No.: 10/233,222

(22) Filed: Sep. 3, 2002

(51) Int. Cl.[7] ..... F01N 3/00

(52) U.S. Cl. ..... 60/295; 60/297; 60/300; 60/311; 55/DIG. 30; 55/341.2; 55/385.3; 137/652.31; 251/63

(58) Field of Search ..... 60/291, 292, 293, 60/295, 297, 300, 303, 307, 311, 324; 55/DIG. 30, 341.2, 385.3, 217; 137/625.31, 599, 115.13; 251/61.2, 63, 63.6, 249.5, 318

(56) References Cited

U.S. PATENT DOCUMENTS

| | | | | |
|---|---|---|---|---|
| 4,270,936 A | | 6/1981 | Mann | |
| 4,276,066 A | | 6/1981 | Bly et al. | |
| 4,281,512 A | | 8/1981 | Mills | |
| 4,319,896 A | | 3/1982 | Sweeney | |
| 4,335,574 A | | 6/1982 | Sato et al. | |
| 4,373,330 A | | 2/1983 | Stark | |
| 4,381,643 A | | 5/1983 | Stark | |
| 4,481,767 A | | 11/1984 | Stark | |
| 4,520,624 A | | 6/1985 | Kiyota et al. | |
| 4,573,317 A | | 3/1986 | Ludecke | |
| 4,651,524 A | * | 3/1987 | Brighton | 60/274 |
| 4,730,455 A | | 3/1988 | Pischinger et al. | |
| 4,840,028 A | * | 6/1989 | Kusuda et al. | 60/303 |
| 4,848,083 A | | 7/1989 | Goerlich | |
| 4,851,015 A | | 7/1989 | Wagner et al. | |
| 5,024,054 A | | 6/1991 | Barris et al. | |
| 5,048,287 A | | 9/1991 | Howe et al. | |
| 5,063,737 A | * | 11/1991 | Lopez-Crevillen et al. | 60/286 |
| 5,065,574 A | | 11/1991 | Bailey | |
| 5,094,075 A | | 3/1992 | Berendes | |
| 5,140,814 A | | 8/1992 | Kreutmair et al. | |
| 5,211,009 A | | 5/1993 | Houben et al. | |
| 5,251,564 A | * | 10/1993 | Rim et al. | 110/344 |
| 5,365,733 A | | 11/1994 | Takeshima et al. | |
| 5,656,048 A | | 8/1997 | Smith et al. | |
| 5,934,069 A | | 8/1999 | Hertl et al. | |
| 5,946,906 A | | 9/1999 | Akazaki et al. | |
| 6,012,284 A | | 1/2000 | Tanaka et al. | |
| 6,063,150 A | | 5/2000 | Peter et al. | |
| 6,182,445 B1 | | 2/2001 | Yamazaki et al. | |
| 6,233,926 B1 | * | 5/2001 | Bailey et al. | 60/295 |
| 6,321,533 B1 | | 11/2001 | Watanabe et al. | |
| 6,327,852 B1 | | 12/2001 | Hirose | |
| 6,334,306 B1 | | 1/2002 | Mori et al. | |
| 6,422,006 B2 | | 7/2002 | Ohmori et al. | |

FOREIGN PATENT DOCUMENTS

GB 2 134 407 A 2/1984

* cited by examiner

*Primary Examiner*—Binh Tran
(74) *Attorney, Agent, or Firm*—Barnes & Thornburg

(57) ABSTRACT

An exhaust processor includes a soot filter and a filter regenerator. The filter regenerator is configured to burn off particulate matter collected in the soot filter to regenerate the soot filter.

20 Claims, 12 Drawing Sheets

EXHAUST PROCESSOR

BACKGROUND

The present disclosure relates to exhaust processors and more particularly to exhaust processors including a soot filter to collect particulate matter from a flow of exhaust gas.

The passages in a soot filter can become occluded by particulate matter collected in the soot filter during use of the soot filter. Occlusion of the passages of the soot filter generates a pressure drop across the soot filter. This pressure drop may be felt by a source of exhaust gas, such as an internal combustion engine, as "backpressure." To reduce this backpressure, the soot filter can be regenerated by burning off the particulate matter collected therein.

SUMMARY

According to the present disclosure, an exhaust processor includes an emission abatement device with some soot filters. The soot filters are configured to collect particulate matter from exhaust gas flowing through the emission abatement device.

The exhaust processor includes a filter regenerator configured to supply hot regenerative fluid to burn off particulate matter collected by the soot filters to regenerate the soot filters. The filter regenerator includes an outlet temperature sensor to sense an outlet temperature associated with an outlet end of each soot filter. The exhaust processor uses the outlet temperature in a feedback loop to control the flow rate and temperature of the regenerative fluid during regeneration of the soot filter associated with the temperature sensor.

The filter regenerator is configured to regenerate the soot filters in sequence so that each soot filter takes a turn at regeneration. Only one of the soot filters is regenerated each time that the filter regenerator detects that the soot filters have collected particulate matter in excess of a predetermined limit (i.e., when a regeneration event occurs). Stated otherwise, only a first of the soot filters is regenerated when a first regeneration event occurs. Only a second of the soot filters is regenerated when a second regeneration event occurs, and so on until all soot filters have been regenerated. After they all have been regenerated, the filter regenerator tarts over with the first of the soot filters at the next regeneration event.

Additional features and advantages of the apparatus will become apparent to those skilled in the art upon consideration of the following detailed description exemplifying the best mode as presently perceived.

BRIEF DESCRIPTION OF THE DRAWINGS

The detailed description particularly refers to the accompanying figures in which.

DETAILED DESCRIPTION OF DRAWINGS

Figure 1:
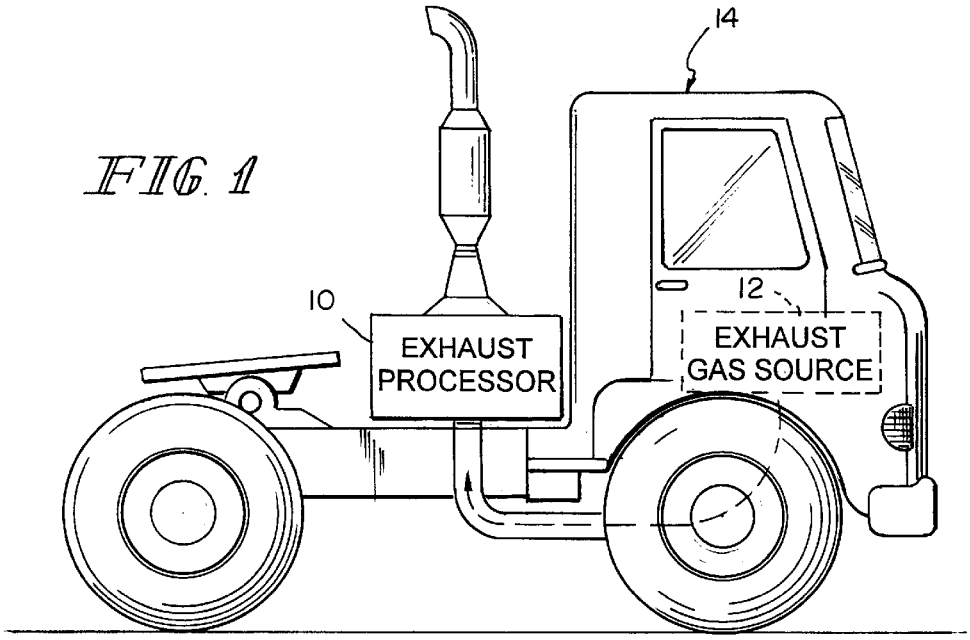
FIG. 1 is a diagrammatic view showing exhaust gas discharged from an exhaust gas source of a vehicle through an exhaust processor.

An exhaust processor 10 is arranged to process a flow of exhaust gas discharged from an exhaust gas source 12, as shown in FIG. 1. Exhaust gas source 12 is, for example, an internal combustion engine, such as a diesel engine, of a vehicle 14. Exhaust processor 10 is configured to collect particulate matter present in the exhaust gas as the exhaust gas flows through exhaust processor 10 to prevent the collected particulate matter from being discharged into the surrounding atmosphere.

Figure 2:
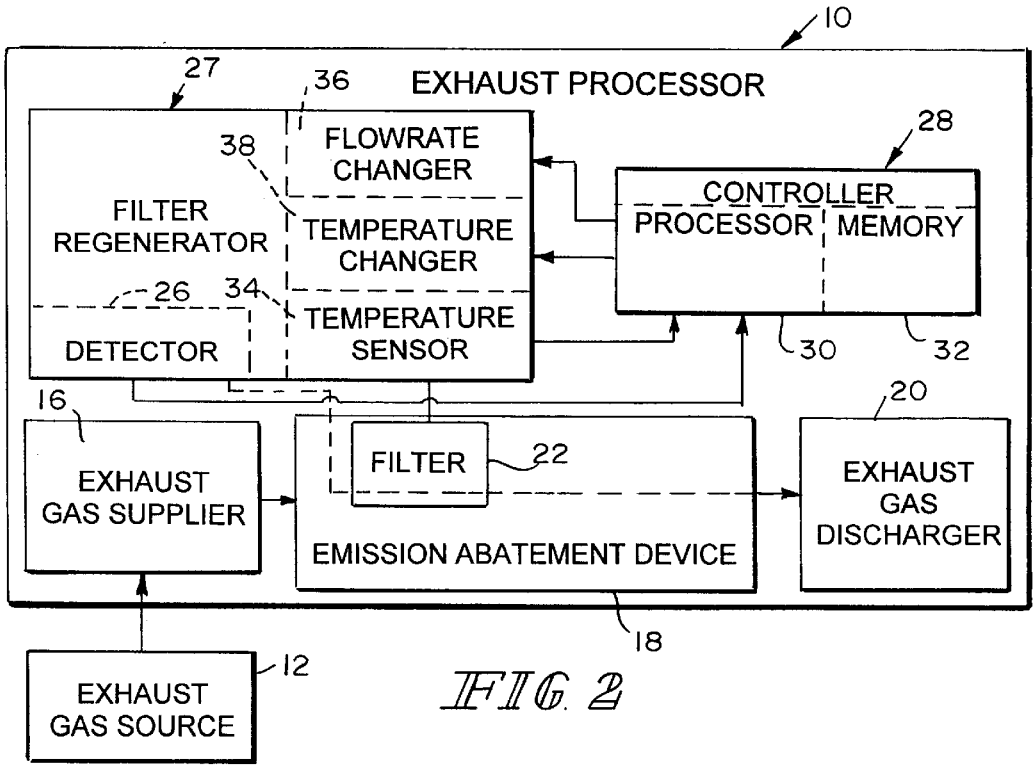
FIG. 2 is a diagrammatic view of the exhaust processor of FIG. 1 showing the exhaust processor including an emission abatement device including a soot filter arranged to collect particulate matter from exhaust gas discharged from the exhaust gas source, and showing the exhaust processor including a filter regenerator arranged to supply regenerative fluid to burn off particulate matter collected in the soot filter and a controller arranged to control operation of the filter regenerator in response to a temperature of the filter sensed by a temperature sensor included in the filter regenerator.

Referring now to the diagrammatic view of FIG. 2, exhaust processor 10 includes an exhaust gas supplier 16, an emission abatement device 18, and an exhaust gas discharger 20. Exhaust gas supplier 16 is arranged to receive a flow of unfiltered exhaust gas from exhaust gas source 12 and to conduct the flow of unfiltered exhaust gas to emission abatement device 18. Emission abatement device 18 includes a soot filter 22 arranged to collect particulate matter present in the flow of unfiltered exhaust gas as the flow of unfiltered exhaust gas passes through passages formed in soot filter 22. A flow of filtered exhaust gas exits from soot filter 22 and passes to exhaust gas discharger 20 which discharges the filtered exhaust gas from exhaust processor 10.

Exhaust processor 10 includes a filter regenerator 27 coupled to emission abatement device 18. Filter regenerator 27 is configured to supply a flow of regenerative fluid to emission abatement device 18 to burn off particulate matter collected in soot filter 22 (i.e., regenerate soot filter 22).

Filter regenerator 27 includes a detector 26, a temperature sensor 34, a flow rate changer 36, and a temperature changer 38. Detector 26 is arranged to detect when the passages formed in soot filter 22 have become occluded or clogged by particulate matter in excess of an occlusion or clogging limit. Temperature sensor 34 is arranged in thermal communication with soot filter 22 to sense a filter temperature associated with soot filter 22 during regeneration of soot filter 22. Flow rate changer 36 is arranged to change the flow rate of a flow of regenerative fluid to soot filter 22. Temperature changer 38 is arranged to change the temperature of the flow of regenerative fluid to soot filter 22.

Exhaust processor 10 includes a controller 28 coupled to filter regenerator 27 to control operation thereof to provide controlled regeneration of soot filter 22. Controller 28 includes a processor 30 and a memory 32 electrically coupled to processor 30. Memory 32 has a plurality of instructions stored therein for execution by processor 30.

Controller 28 is electrically coupled to detector 26, temperature sensor 34, flow rate changer 36, and temperature changer 38. Controller 28 is arranged to cause filter regenerator 27 to supply regenerative fluid to soot filter 22 when detector 26 detects the clogging limit. Controller 28 is arranged to receive the filter temperature sensed by temperature sensor 34 and is arranged to operate flow rate changer 36 and temperature changer 38 in response to the filter temperature sensed by the temperature sensor 34 to change the flow rate and temperature of the flow of regenerative fluid to soot filter 22 as needed to maintain the filter temperature at a regeneration temperature during regeneration of soot filter 22. The regeneration temperature is, for example, 605° Celsius plus or minus a tolerance, such as 5° Celsius.

Controller 28 thus provides control means for controlling operation of flow rate changer 36 and temperature changer 38 to change the flow rate and the regenerative fluid temperature in response to the filter temperature sensed by temperature sensor 34. Using controller 28, flow rate changer 36 and temperature changer 38 are operated to maintain the filter temperature at the regeneration temperature during regeneration of soot filter 22.

Figure 3:
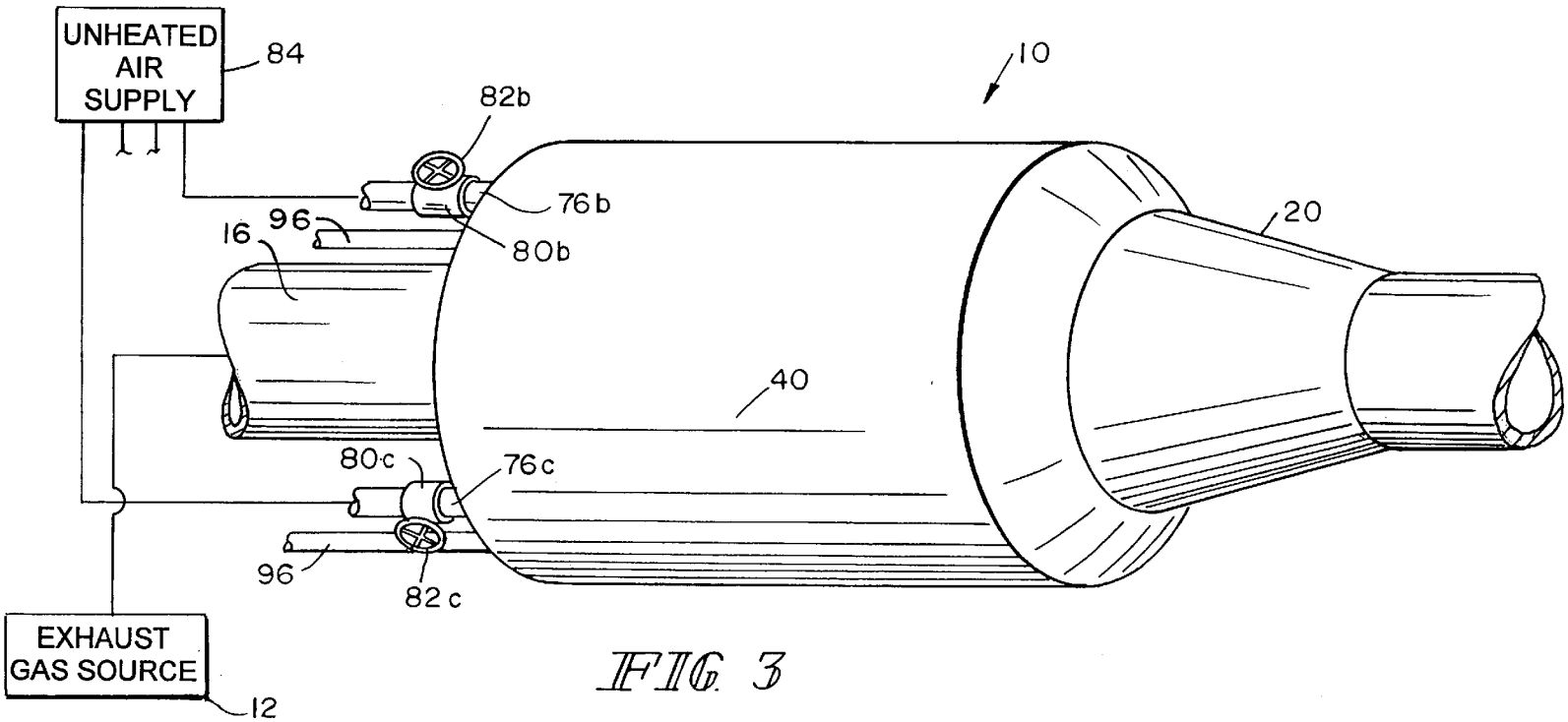
FIG. 3 is a perspective view of the exhaust processor of FIG. 1.
Figure 4:
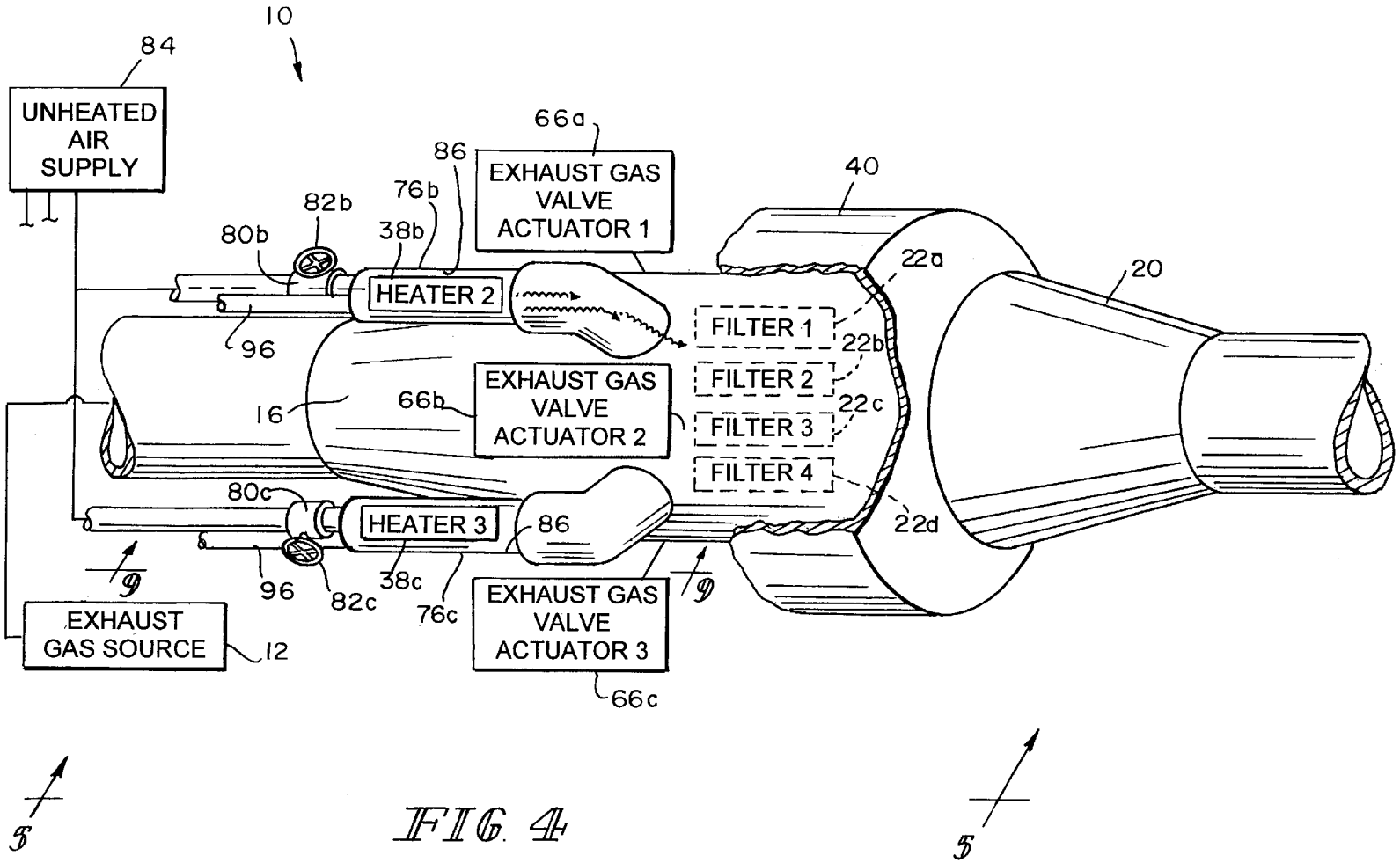
FIG. 4 is a perspective view of the exhaust processor of FIG. 3, with portions broken away, showing four soot filters contained in the emission abatement device and pipes of the filter regenerator containing heaters to heat air from an unheated air supply to provide heated air for regeneration of associated soot filters.
Figure 5:
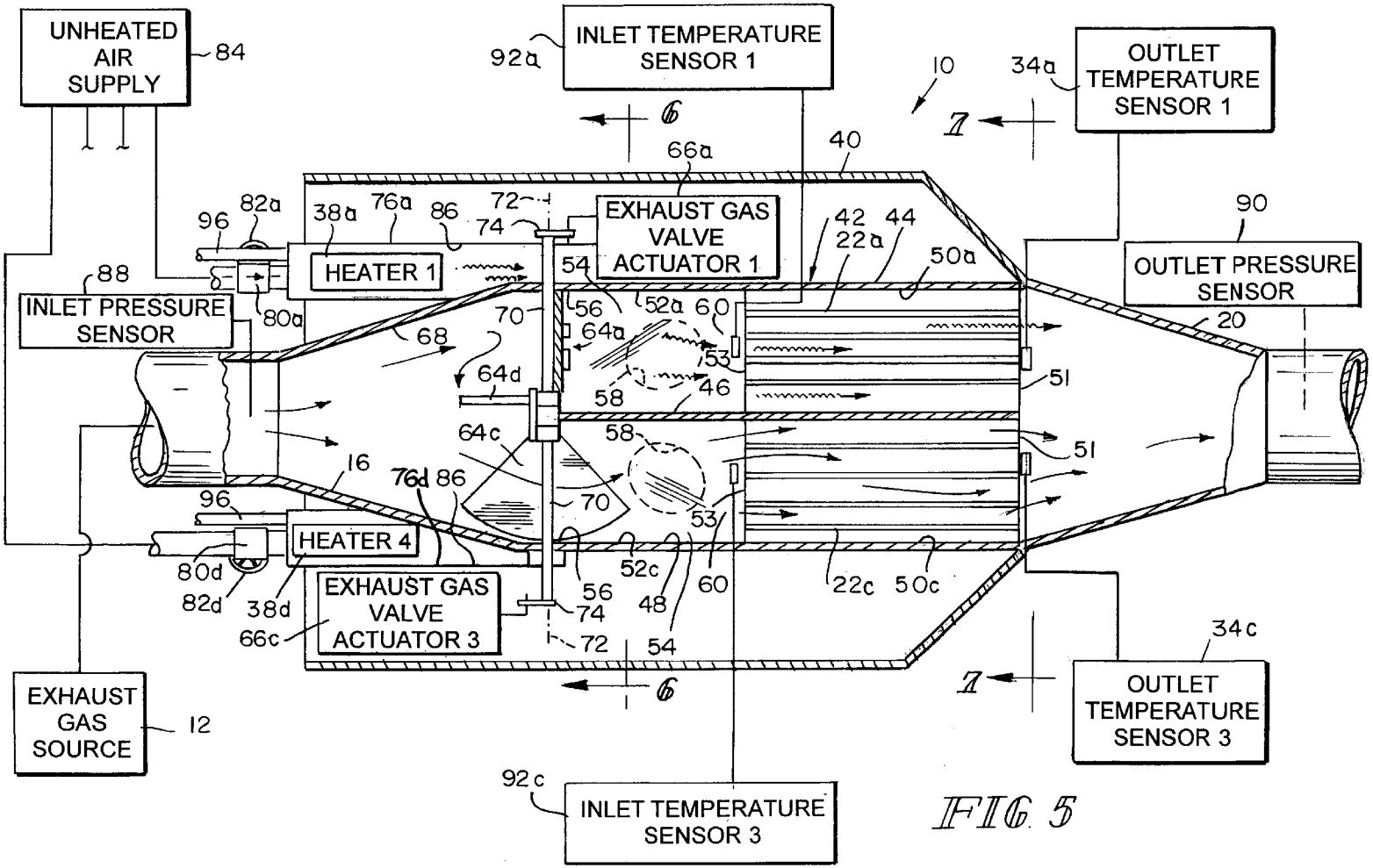
FIG. 5 is a sectional view taken along line 5—5 of FIG. 4 showing a flow of exhaust gas from the exhaust gas source routed through a lower soot filter for collection of particulate matter therein and a flow of air supplied by the unheated air supply and heated by an upper, first heater routed through an upper soot filter for regeneration of the upper soot filter and further showing lower and upper regeneration chambers immediately upstream from the lower and upper soot filters to receive either exhaust gas from an associated filtration inlet or heated air from an associated regeneration inlet (shown in dotted)

Details of exhaust processor 10 are shown in FIGS. 3–10. For example, exhaust gas supplier 16 takes the form of an inlet cone as shown in FIGS. 3–6 and exhaust gas discharger 20 takes the form of an outlet cone as shown in FIGS. 3–5. A guard 40 surrounds emission abatement device 18 and other portions of exhaust processor 10, as shown in FIGS. 3–7, to block dirt and other external substances from collecting on external surfaces of exhaust processor 10.

Figure 6:
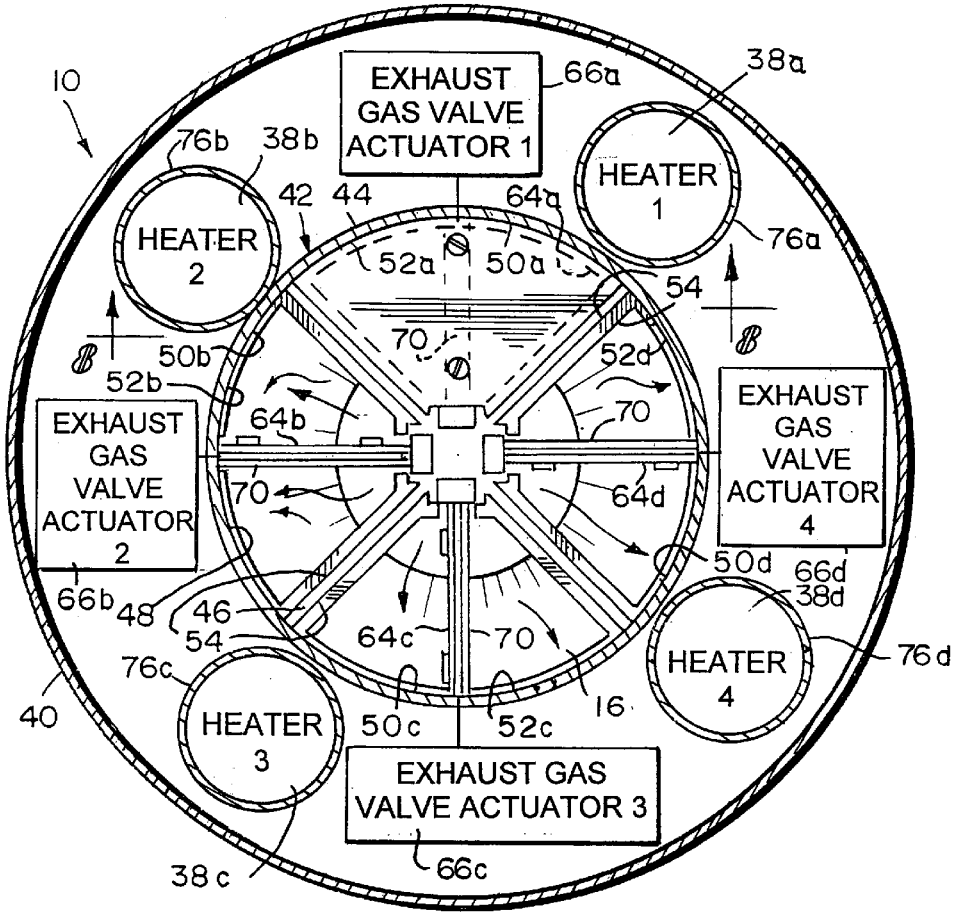
FIG. 6 is a sectional view taken along line 6—6 of FIG. 5 showing four heaters located in associated pipes spaced circumferentially about a cylindrical exterior side wall of a housing of the emission abatement device wherein the housing further includes an X-shaped partition within the exterior side wall so that the exterior side wall and the partition cooperate to provide four regeneration chambers and showing an exhaust gas valve associated with the upper regeneration chamber closed to block flow of exhaust gas into the upper regeneration chamber while exhaust gas valves associated with the other three regeneration chambers are opened to allow flow of exhaust gas through those regeneration chambers.
Figure 7:
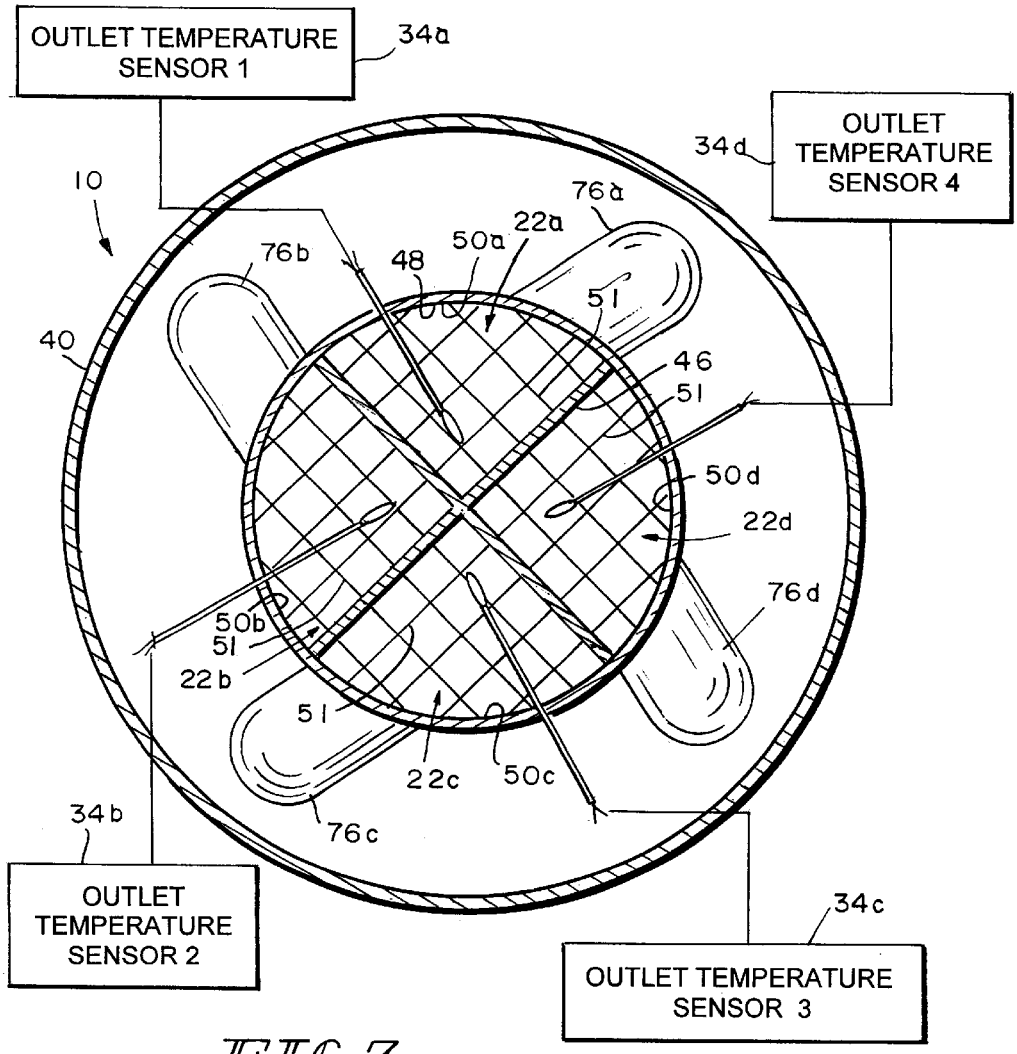
FIG. 7 is a section view taken along line 7—7 of FIG. 5 showing four outlet temperature sensors wherein each outlet temperature sensor is associated with an outlet end of one of the four soot filters.

Emission abatement device 18 includes a housing 42 that interconnects exhaust gas supplier 16 and exhaust gas discharger 20, as shown in FIGS. 4 and 5. Housing 42 includes an exterior cylindrical side wall 44 extending between exhaust gas supplier 16 and exhaust gas discharger 20 and an interior partition 46 that divides an interior region 48 formed by side wall 44 into four smaller interior regions 50*a*, 50*b*, 50*c*, 50*d*, as shown in FIGS. 6 and 7. Partition 46 is X-shaped, as shown in FIG. 7, and is fixed to side wall 44.

Exhaust processor 10 includes four soot filters 22*a*, 22*b*, 22*c*, 22*d*. Each soot filter 22*a*, 22*b*, 22*c*, 22*d* is positioned in a downstream portion of one of interior regions 50*a*, 50*b*, 50*c*, 50*d*, as suggested in FIGS. 5 and 7. Each soot filter 22*a*, 22*b*, 22*c*, 22*d* includes an outlet end 51 positioned in close proximity to exhaust gas discharger 20 and has a cross section configured as a quarter section of a circle.

Emission abatement device 18 includes four regeneration chambers 52*a*, 52*b*, 52*c*, 52*d* located in an upstream portion of interior region 48. Side wall 44 and partition 46 cooperate to provide each regeneration chamber 52*a*, 52*b*, 52*c*, 52*d*. Each regeneration chamber 52*a*, 52*b*, 52*c*, 52*d* is formed to include an upstream portion of each smaller interior region 50*a*, 50*b*, 50*c*, 50*d* and is associated with an inlet end 53 of one of soot filters 22*a*, 22*b*, 22*c*, 22*d*.

Each regeneration chamber 52*a*, 52*b*, 52*c*, 52*d* includes a flow passage 54, a filtration inlet 56, a regeneration inlet 58, and an outlet 60. Each filtration inlet 56 is coupled exhaust gas supplier 16 and configured to pass unfiltered exhaust gas flowing through exhaust gas supplier 16 into flow passage 54. Each regenerative fluid inlet 56 is configured to pass regenerative fluid into flow passage 54. Each outlet 60 is configured to discharge fluid from flow passage 54 into one of the inlet ends 53.

Figure 10:
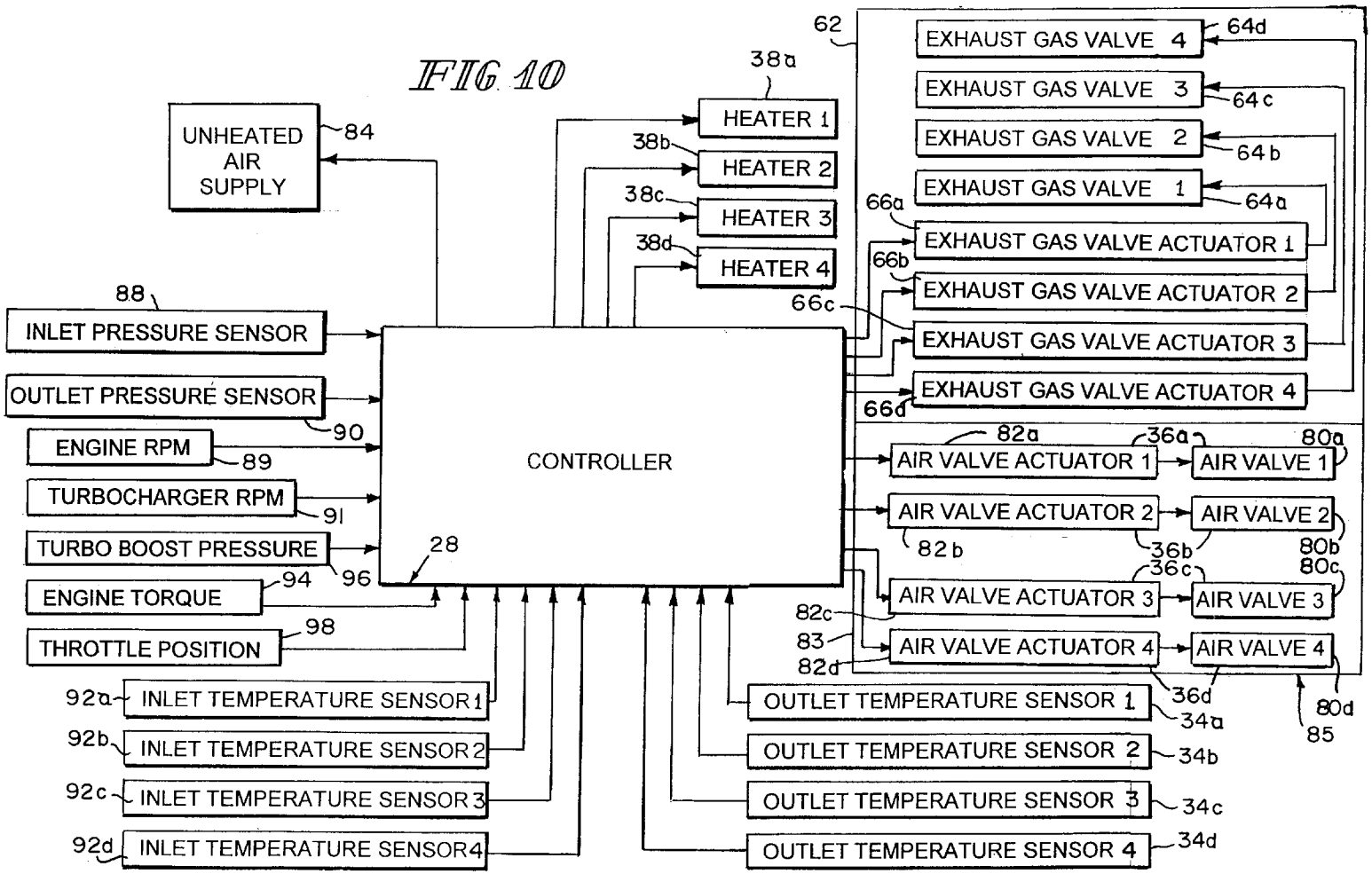
FIG. 10 is a diagrammatic view showing a controller of the exhaust processor and its relation to various components.

Filter regenerator 27 includes an exhaust gas router 62 arranged to control flow of exhaust gas through filtration inlets 56, as shown in FIG. 10. Exhaust gas router 62 includes a filtration inlet closer, such as an exhaust gas valve 64*a*, 64*b*, 64*c*, 64*d*, associated with each filtration inlet 56, as shown in FIGS. 5 and 6. Exhaust gas router 62 further includes an exhaust gas valve actuator 66*a*, 66*b*, 66*c*, 66*d* associated with each exhaust gas valve 64*a*, 64*b*, 64*c*, 64*d*, as shown in FIGS. 4–6. Exhaust gas valve actuators 66*a*, 66*b*, 66*c*, 66*d* cooperate to provide a filtration inlet closer operator.

Each exhaust gas valve actuator 66*a*, 66*b*, 66*c*, 66*d* is coupled to one of exhaust gas valves 64*a*, 64*b*, 64*c*, 64*d*, for pivotable movement of the exhaust gas valve 64*a*, 64*b*, 64*c*, 64*d*, in one of filtration inlets 56 between an opened position allowing a flow of exhaust gas from a flow passage 68 formed in exhaust gas supplier 16 to flow passage 54 of one of regeneration chambers 52*a*, 52*b*, 52*c*, 52*d* and a closed position blocking a flow of exhaust gas from flow passage 68 to flow passage 54.

Figure 8:
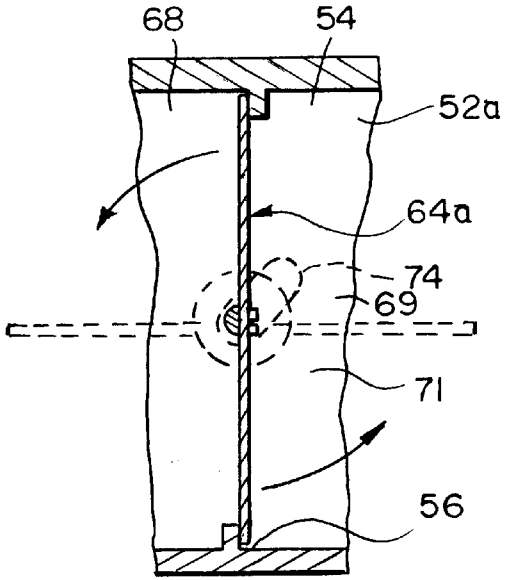
FIG. 8 is a sectional view taken along line 8—8 of FIG. 6 showing, in solid lines, one of the exhaust gas valves in its closed position and showing, in dotted lines, the exhaust gas valve in its opened position.
Figure 9:
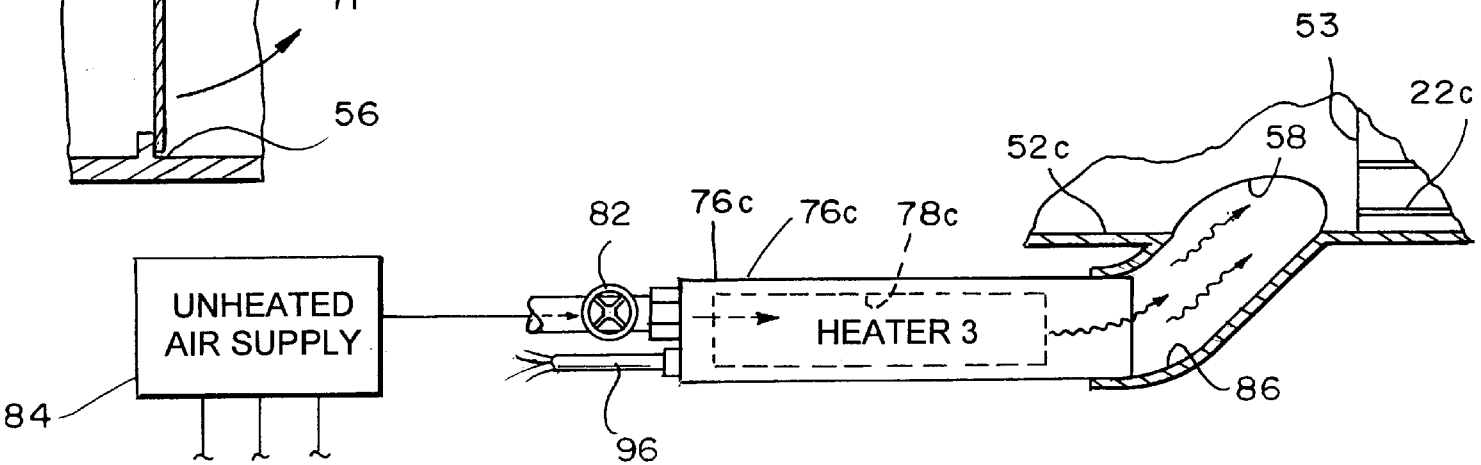
FIG. 9 is a sectional view taken along line 9—9 of FIG. 4 showing one of the heaters located in a passage formed in one of the pipes of the filter regenerator to conduct a flow of unheated air from the unheated air supply to a regeneration inlet associated with one of the regeneration chambers for regeneration of one of the soot filters.

Each exhaust gas valve 64*a*, 64*b*, 64*c*, 64*d*, includes a valve plate and a pair of fasteners that attach the valve plate to a pivot shaft 70 of the exhaust gas valve actuator 66*a*, 66*b*, 66*c*, 66*d* associated with the exhaust gas valve 64*a*, 64*b*, 64*c*, 64*d*. A first portion of the valve plate lies in flow passage 68 and a second portion of the valve plate lies in flow passage 54 of the regeneration chamber 52*a*, 52*b*, 52*c*, 52*d* associated with the valve plate when the valve plate is opened to provide a first flow-conducting passage 69 through the filtration inlet 56 on one side of the valve plate and a second flow-conducting passage 71 through the filtration inlet 56 on an opposite side of the valve plate, as shown in FIG. 8. Each valve plate has a cross-section configured as a quarter section of a circle.

Each pivot shaft 70 establishes a pivot axis 72 about which the valve plate is pivoted between the opened and closed positions, as shown in FIG. 5 with respect to exhaust gas valve actuators 66*a*, 66*c*. A pivot arm 74 of each exhaust gas valve actuator 66*a*, 66*b*, 66*c*, 66*d* extends perpendicularly-to each pivot shaft 70 to pivot the pivot shaft 70 about its pivot axis 72. Each exhaust gas valve actuator 66*a*, 66*b*, 66*c*, 66*d* includes an arm operator (not shown) to operate one of pivot arms 74. An example of such an arm operator includes a fluid-actuated piston extensible from a cylinder. The fluid for actuating the piston is supplied, for example, by the vacuum created by the engine of vehicle 14. Each exhaust gas valve actuator 66*a*, 66*b*, 66*c*, 66*d* provides means for pivoting the exhaust gas valve 64*a*, 64*b*, 64*c*, 64*d*, associated therewith between the opened and closed positions.

Filter regenerator 27 includes pipes 76*a*, 76*b*, 76*c*, 76*d* (see FIGS. 3–7 and 9), temperature changers that take the form of electric heaters 38*a*, 38*b*, 38*c*, 38*d* (see FIGS. 4–6, 9, and 10), regeneration inlet closers 80*a*, 80*b*, 80*c*, 80*d* (see FIGS. 3–5, and 10), a regeneration inlet closer operator, and an unheated air supply 84 (see FIGS. 3–5, 9, and 10). Regeneration inlet closers 80*a*, 80*b*, 80*c*, 80*d* take the form of air valves 80*a*, 80*b*, 80*c*, 80*d* and regeneration inlet closer operator includes air valve actuators 82*a*, 82*b*, 82*c*, 82*d* (see FIGS. 3–5, 9, and 10). The regeneration inlet closer operator and the filtration inlet closer operator cooperate to provide a closer operator. Air valves 80*a*, 80*b*, 80*c*, 80*d* and air valve actuators 82*a*, 82*b*, 82*c*, 82*d* cooperate to provide a regenerative fluid flow router 83. Regenerative fluid flow router 83 and exhaust gas flow router 62 cooperate to provide a flow router 85 arranged to regulate flow of regenerative fluid and exhaust gas through soot filters 22*a*, 22*b*, 22*c*, 22*d*, as shown in FIG. 10.

Each pipe 76*a*, 76*b*, 76*c*, 76*d* is coupled to exterior side wall 44 at one of regeneration inlets 58 and is formed to include a passage 86 in which one of electric heaters 38*a*, 38*b*, 38*c*, 38*d* is positioned to heat a flow of air from unheated air supply 84 to provide a flow of heated air to regenerate one of the soot filters 22*a*, 22*b*, 22*c*, 22*d*. Each air valve 80*a*, 80*b*, 80*c*, 80*d* is fluidly interposed between unheated air supply 84 and one of electric heaters 38*a*, 38*b*, 38*c*, 38*d* and each air valve actuator 82*a*, 82*b*, 82*c*, 82*d* is coupled to one of air valves 80*a*, 80*b*, 80*c*, 80*d* to operate the air valve 80*a*, 80*b*, 80*c*, 80*d* to control a flow rate of the flow of unheated air from unheated air supply 84 through the passage 86 containing the electric heater 38*a*, 38*b*, 38*c*, 38*d*. Air valves 80*a*, 80*b*, 80*c*, 80*d* and air valve actuators thus cooperate to provide flow rate changers 36*a*, 36*b*, 36*c*, 36*d* (see FIG. 10). Each air valve 80*a*, 80*b*, 80*c*, 80*d* thus provides means for blocking a flow of air in one of the passages 86 through one of the regeneration inlets 58.

Unheated air supply 84 is, for example, an air pump dedicated to provide a flow of unheated air for regeneration of soot filters 22*a*, 22*b*, 22*c*, 22*d*. In other embodiments, unheated air supply 84 is, for example, a pneumatic line attached to one or air brake lines of vehicle 14.

Detector 26 of filter regenerator 27 includes an inlet pressure sensor 88 and an outlet pressure sensor 90, as shown in FIGS. 5 and 10. Inlet pressure sensor 88 extends within exhaust gas supplier 16 and outlet pressure sensor 90 extends within exhaust gas discharger 20. Inlet and outlet pressure sensors 88, 90 provide pressure information to controller 28 which determines the pressure drop across soot filters 22*a*, 22*b*, 22*c*, 22*d*. The controller 28 can determine whether soot filters 22*a*, 22*b*, 22*c*, 22*d* have, as a unit, reached their clogging limit based on the pressure drop across soot filters 22*a*, 22*b*, 22*c*, 22*d* and other controller inputs such as the engine speed 89 measured in revolutions per minute or rpm's, the engine torque 94, the turbocharger rpm's 91 of a turbocharger (not shown) associated with the engine, the turbo boost pressure 96 of the turbocharger, and the position 98 of the throttle (not shown) of vehicle 14, as shown in FIG. 10.

Filter regenerator 27 includes inlet temperature sensors 92*a*, 92*b*, 92*c*, 92*d*, as shown in FIGS. 5 and 10. Each inlet temperature sensor 92*a*, 92*b*, 92*c*, 92*d* is positioned in in close proximity to one of the inlet ends 53 to sense an inlet temperature of a flow of heated air entering the inlet end 53 and provides the inlet temperature to controller 28. Controller 28 uses the inlet temperature to determine whether filter regenerator 27 is supplying the flow of heated air to the soot filter 22*a*, 22*b*, 22*c*, 22*d*.

Filter regenerator 27 includes outlet temperature sensors 34*a*, 34*b*, 34*c*, 34*d*, as shown in FIGS. 5, 7, and 10. Each outlet temperature sensor 34*a*, 34*b*, 34*c*, 34*d*, is positioned in thermal communication with one of outlet ends 51 to sense an outlet temperature associated with the outlet end 51 and provides the outlet temperature to controller 28. Controller 28 uses the outlet temperature to control regeneration of soot filters 22*a*, 22*b*, 22*c*, 22*d*.

When controller 28 determines that the clogging limit of soot filters 22*a*, 22*b*, 22*c*, 22*d* has been exceeded based on information from pressure sensors 88, 90, controller 28 selects one of soot filters 22*a*, 22*b*, 22*c*, 22*d* for regeneration. For purposes of illustration, it is assumed that soot filter 22*a* is selected for regeneration. In this case, controller 28 causes exhaust gas valve actuator 66*a* to move exhaust gas valve 64*a* to its closed position to block exhaust gas from flowing through filtration inlet 56 associated with soot filter 22*a* into regeneration chamber 52*a* and through soot filter 22*a*. At the same time, the other exhaust gas valves 64*b*, 64*c*, 64*d*, remain in their opened positions to allow exhaust gas to flow the filtration inlets 56 associated with soot filters 22*b*, 22*c*, 22*d* into regeneration chambers 52*b*, 52*c*, 52*d* and through soot filters 22*b*, 22*c*, 22*d* so that exhaust gas continues to be filtered during regeneration of soot filter 22*a*.

Controller 28 operates unheated air supply 84 to provide a flow of unheated air for regeneration of soot filter 22*a*. Controller 28 operates air valve actuator 82*a* to open air valve 80*a* to allow a flow of air from supply 84 into passage 86 of pipe 76*a* while air valve actuators 82*b*, 82*c*, 82*d* maintain air valves 80*b*, 80*c*, 80*d* in their closed positions to block a flow of air from supply 84 into passages 86 of pipes 76*b*, 76*c*, 76*d*. Controller 28 further operates electric heater 38*a* via an electrical line 96. (see FIG. 5) to heat air flowing from supply 84 past air valve 80*a* through passage 86, regeneration inlet 58, regeneration chamber 52*a*, and soot filter 22*a*.

Controller 28 operates air valve actuator 82*a* and electric heater 38*a* in response to the outlet temperature sensed by outlet temperature sensor 34*a*. During regeneration of soot filter 22*a*, controller is programmed to operate air valve actuator 82*a* and electric heater 38*a* as needed to maintain the outlet temperature at the regeneration temperature. Controller 28 can operate air valve actuator 82*a* to increase or decrease the flow rate of the heated air flowing through soot filter 22*a*. In addition, controller 28 can operate electric heater 38*a* to increase or decrease the temperature of the heated air. For example, if the outlet temperature is too high (i.e., above the tolerance of the regeneration temperature) or too low (i.e., below the tolerance of the regeneration temperature), controller 28 can decrease or increase the heat output of electric heater 38*a*. In addition, if more or less oxygen is needed to maintain the outlet temperature at the regeneration temperature, controller 28 can operate air valve actuator 82*a* to move air valve 80*a* more toward its fully opened or fully closed positions.

After regeneration of soot filter 22*a* is completed, controller 28 causes exhaust gas valve 64*a* to be re-opened and air valve 80*a* to be re-closed to allow exhaust gas to flow through all soot filters 22*a*, 22*b*, 22*c*, 22*d* once again. In addition, controller 28 turns off electric heater 38*a* and unheated air supply 84 (if supply 84 is a separately dedicated air pump).

When controller 28 determines that the pressure drop across emission abatement device 120 has exceeded the clogging limit again, soot filter 22*b* is regenerated. This process is repeated until all soot filters 22*a*, 22*b*, 22*c*, 22*d* have been regenerated to complete one regeneration cycle. After all soot filters 22*a*, 22*b*, 22*c*, 22*d* have been regenerated, the regeneration cycle starts over with soot filter 22*a*. Thus, controller 28 and filter regenerator 27 provide means for sequentially regenerating soot filters 22*a*, 22*b*, 22*c*, 22*d* wherein only one of soot filters 22*a*, 22*b*, 22*c*, 22*d* is regenerated to reduce particulate matter collected in the soot filters 22*a*, 22*b*, 22*c*, 22*d* below a clogging limit each time the particulate matter collected in the soot filters 22*a*, 22*b*, 22*c*, 22*d* exceeds the clogging limit.

Figure 11:
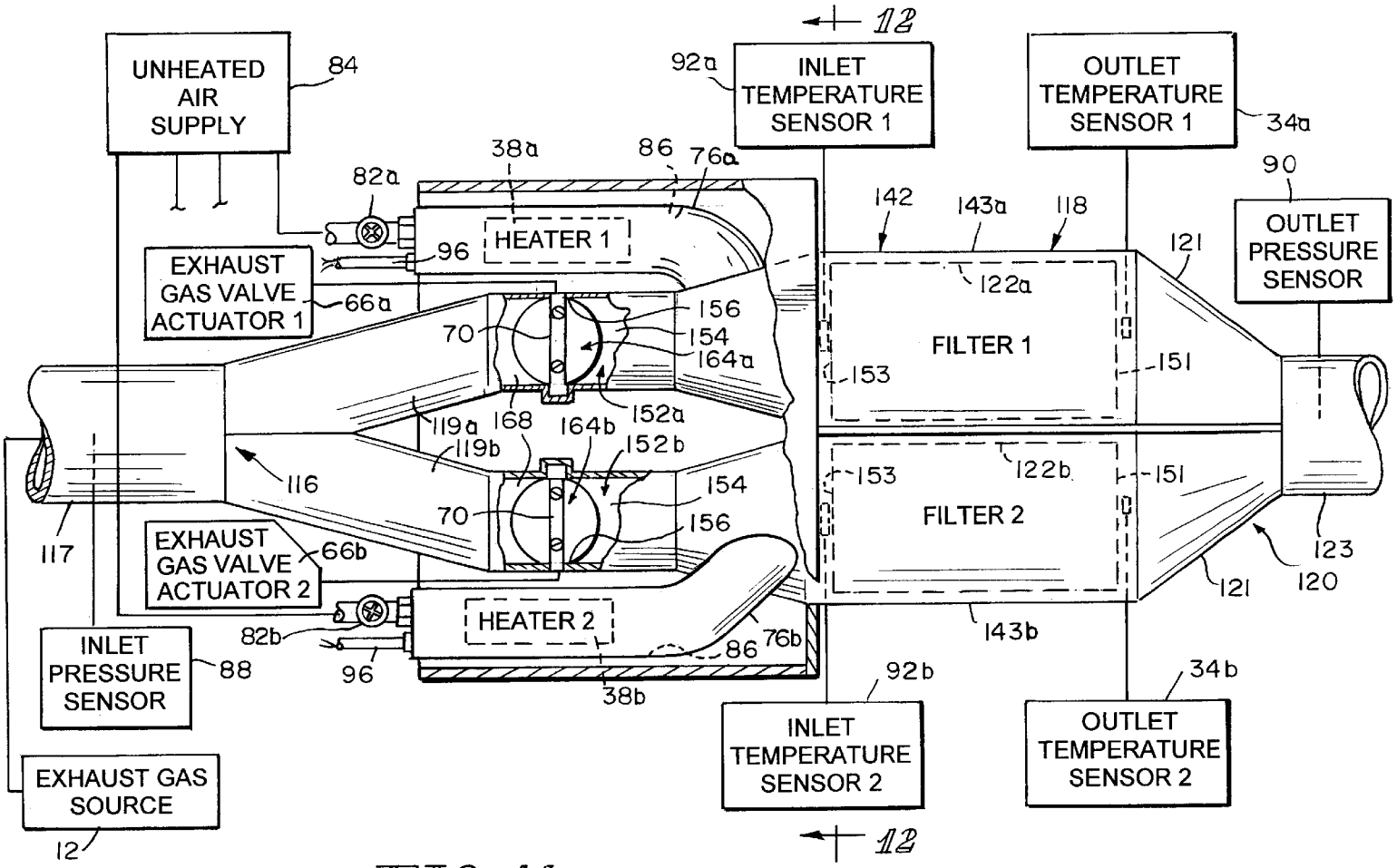
FIG. 11 is an elevation view, with portions broken away, of another exhaust processor.
Figure 12:
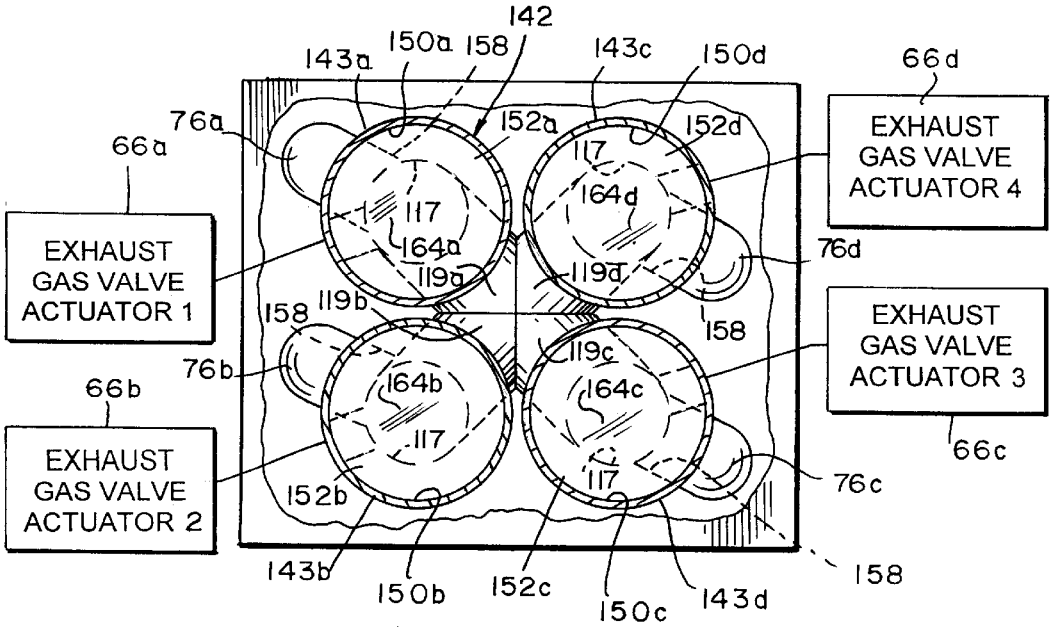
FIG. 12 is a sectional view taken along line 12—12 of FIG. 11.

An exhaust processor 110 is shown in FIGS. 11 and 12. Exhaust processor 110 is similar in structure and function to exhaust processor 10, except as otherwise noted, so that identical reference numerals refer to similar structures. Exhaust processor 110 includes filter regenerator 27, controller 28, an exhaust gas supplier 116, an emission abatement device 118, and an exhaust gas discharger 120.

Exhaust gas supplier 116 includes an inlet pipe 117 and four inlet transition pipes 119*a*, 119*b*, 119*c*, 119*d*, as shown in FIGS. 11 and 12. Inlet pipe 117 receives exhaust gas from exhaust gas source 12. Each inlet transition pipe 119*a*, 119*b*, 119*c*, 119d is formed to include a flow passage 168 that receives a flow of exhaust gas from inlet pipe 117 and conducts the flow of exhaust gas to emission abatement device 18. Inlet pressure sensor 88 extends into inlet pipe 117.

Exhaust gas discharger 120 includes four outlet transition pipes 121 and an outlet pipe 123, as shown in FIG. 11. Outlet transition pipes 121 receive a flow of exhaust gas from emission abatement device 118 and conduct the flow of exhaust gas to outlet pipe 123. Outlet pipe 123 discharges the flow of exhaust gas from exhaust processor. Outlet pressure sensor extends into outlet pipe 123.

Emission abatement device 118 includes a housing 142, as shown in FIGS. 11 and 12. Housing 142 includes four housing pipes 143*a*, 143*b*, 143*c*, 143*d*. Each housing pipe 143*a*, 143*b*, 143*d*, 143*d* interconnects one of inlet transition pipes 119*a*, 119*b*, 119*c*, 119*d* and one of outlet transition pipes 121 and is formed to include an interior region 150*a*, 150*b*, 150*c*, 150*d*, as shown in FIG. 12, which cooperate to provide an overall interior region formed in housing 142.

Emission abatement device 118 includes four soot filters 122*a*, 122*b*, 122*c*, 122*d* to collect particulate matter present in exhaust gas flowing through soot filters 122*a*, 122*b*, 122*c*, 122*d*. Each soot filter 122*a*, 122*b*, 122*c*, 122*d* is positioned in a downstream portion of one of interior regions 150*a*, 150*b*, 150*c*, 150*d* and has a circular cross-section. An outlet end 151 of each soot filter 122*a*, 122*b*, 122*c*, 122*d* is positioned in close proximity to one of outlet transition pipes 121.

Each housing pipe 143*a*, 143*b*, 143*c*, 143*d* includes a regeneration chamber 152*a*, 152*b*, 152*c*, 152*d* formed to include an upstream portion of one of interior regions 150*a*, 150*b*, 150*c*, 150, as shown in FIGS. 11 and 12. Each regeneration chamber 152*a*, 152*b*, 152*c*, 152*d* is formed to include a filtration inlet 156, a regeneration inlet 158, and a flow passage 154 to conduct a flow of fluid (i.e., exhaust gas or regenerative fluid such as heated air) from filtration inlet 156 or regeneration inlet 158 to an inlet end 153 of one of soot filters 122*a*, 122*b*, 122*c*, 122*d*.

Filter regenerator 27 includes four filtration inlet closers that take the form of four exhaust gas valves 164*a*, 164*b*, 164*c*, 164*d*, (see FIGS. 11 and 12) which are similar to exhaust gas valves 64*a*, 64*b*, 64*c*, 64*d*, except that the valve plate of each valve 164*a*, 164*b*, 164*c*, 164*d*, has a circular cross-section instead of a quarter-circle cross-section. Thus, the function of exhaust gas valves 164*a*, 164*b*, 164*c*, 164*d*, is the same as the function of exhaust gas valves 64*a*, 64*b*, 64*c*, 64*d*. Each exhaust gas valve 164*a*, 164*b*, 164*c*, 164*d*, is located in one of housing pipes 143*a*, 143*b*, 143*c*, 143*d* between one of inlet transition pipes 119*a*, 119*b*, 119*c*, 119*d* and one of regeneration chambers 152*a*, 152*b*, 152*c*, 152*d*, as shown in FIG. 11 to control flow of exhaust gas through one of filtration inlets 156. Exhaust gas valves 164*a*, 164*b*, 164*c*, 164*d*, and exhaust gas valve actuators 66*a*, 66*b*, 66*c*, 66*d* associated therewith cooperate to provide exhaust gas flow router 62 of exhaust processor 110.

Each pipe 76*a*, 76*b*, 76*c*, 76*d* of filter regenerator 27 is coupled to one of housing pipes 143*a*, 143*b*, 143*c*, 143*d* at one of regeneration inlets 158, as suggested in FIG. 12. Each pipe 76*a*, 76*b*, 76*c*, 76*d* contains one of electric heaters 38*a*, 38*b*, 38*c*, 38*d* in passage 86 formed therein and is operated by controller 28 via one of electrical lines 96. One of air valves 80*a*, 80*b*, 80*c*, 80*d* and one of air valve actuators 82*a*, 82*b*, 82*c*, 82*d* is associated with each pipe 76*a*, 76*b*, 76*c*, 76*d* to control flow of air from unheated air supply 84 to one of passages 86.

Each of inlet temperature sensors 92*a*, 92*b*, 92*c*, 92*d* and outlet temperature sensors 34*a*, 34*b*, 34*c*, 34*d*, extends into one of interior regions 150*a*, 150*b*, 150*c*, 150*d*. Each inlet temperature sensor 92*a*, 92*b*, 92*c*, 92*d* is positioned in close proximity to one of inlet ends 153. Each outlet temperature sensor 34*a*, 34*b*, 34*c*, 34*d*, is positioned in close proximity and in thermal communication with one of outlet ends 151 to sense an outlet temperature associated with the outlet end 151.

Figure 13:
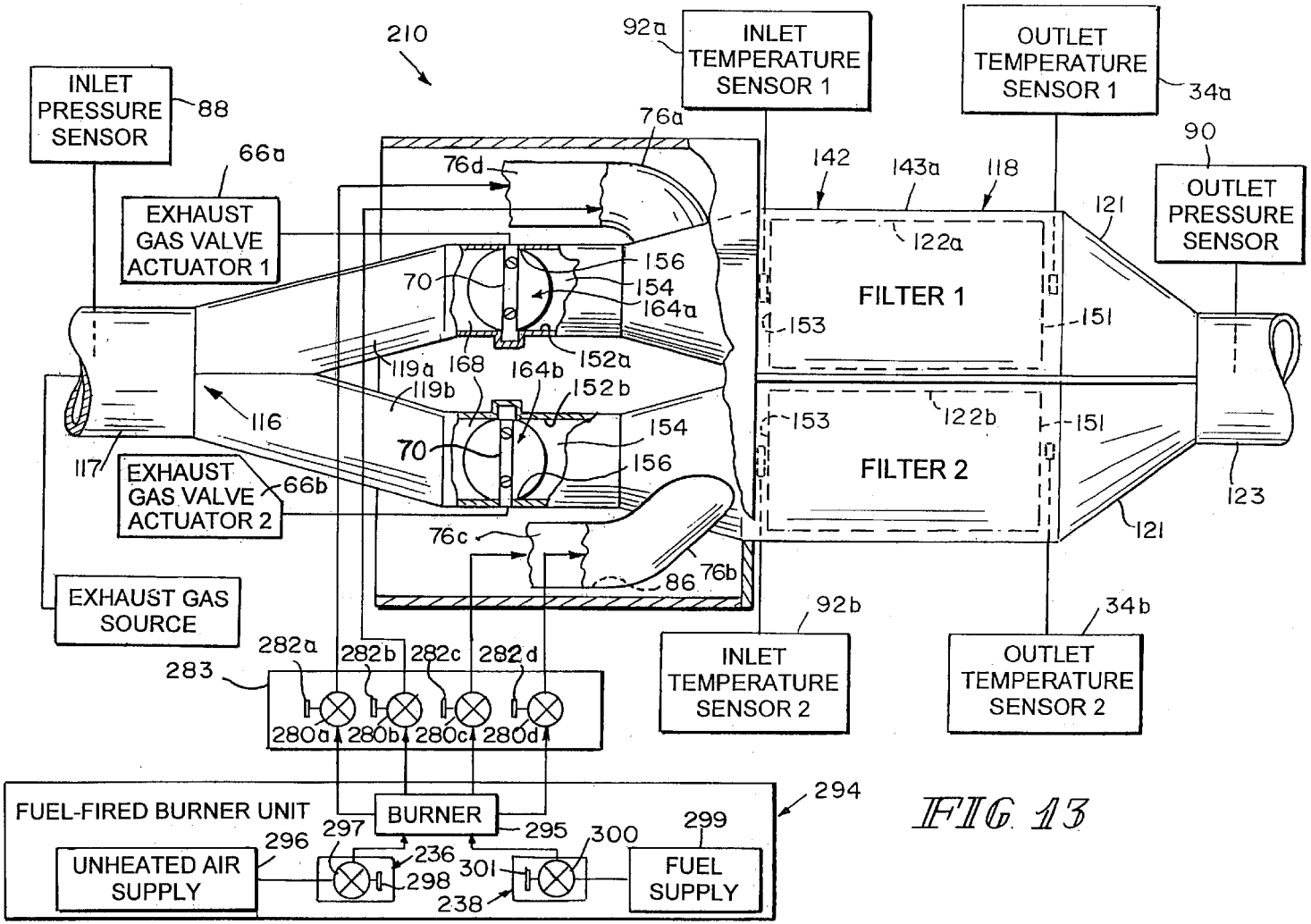
FIG. 13 is an elevation view, with portions broken away, of another exhaust processor showing the exhaust processor including a fuel-fired burner unit to supply regenerative fluid for regeneration of soot filters of the exhaust processor.
Figure 14:
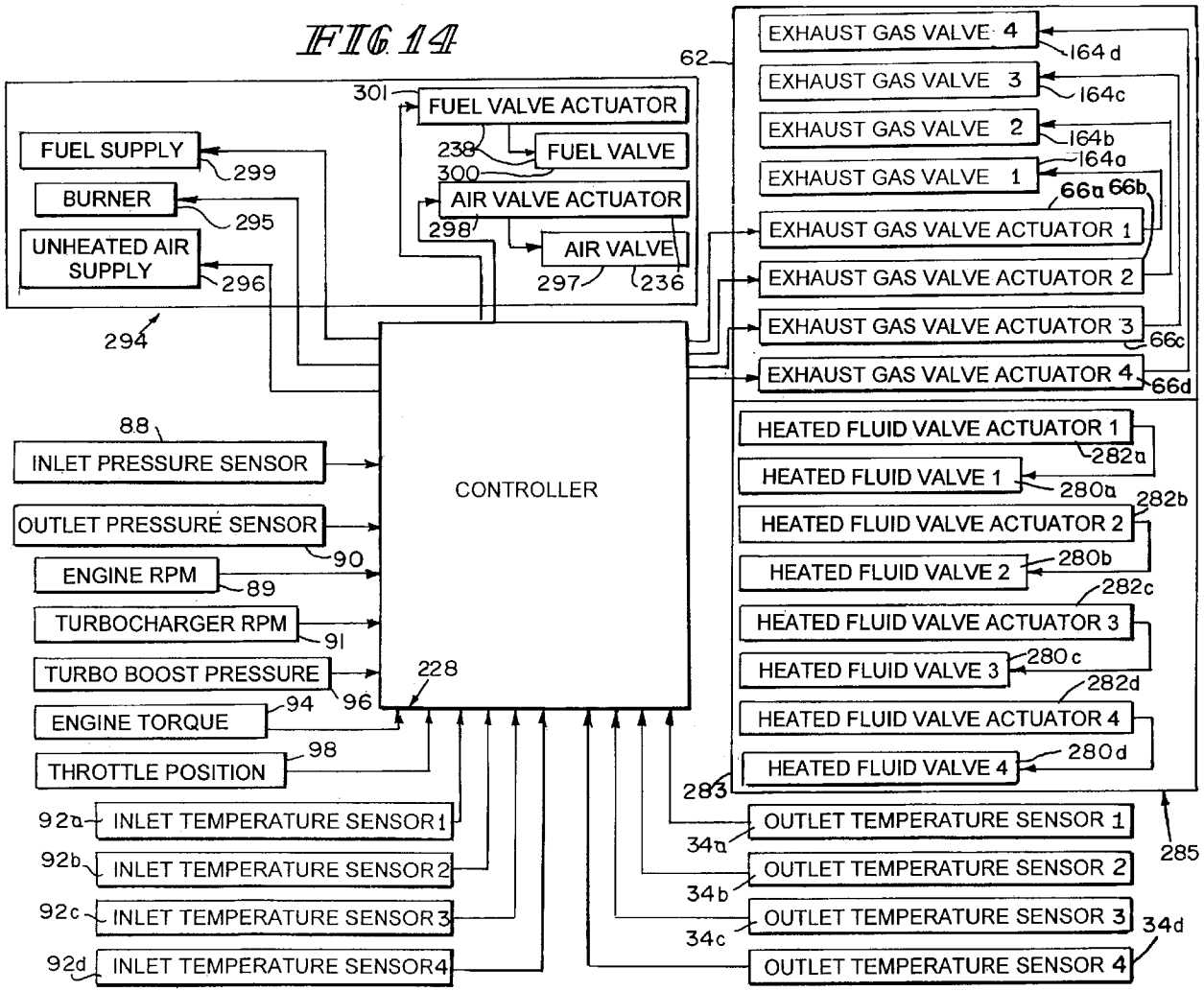
FIG. 14 is a diagrammatic view showing a controller of the exhaust processor of FIG. 13 and its relation to various components.

An exhaust processor 210 is shown in FIGS. 13 and 14. Exhaust processor 210 is similar in structure and function to exhaust processor 110, except as otherwise noted, so that identical reference numerals refer to similar structures. Exhaust processor 210 includes a filter regenerator 227 that uses a fuel-fired burner unit 294 to supply regenerative fluid for regeneration of soot filters 122*a*, 122*b*, 122*c*, 122*d*.

Filter regenerator 227 includes four pipes 76*a*, 76*b*, 76*c*, 76*d*, as shown in FIG. 13. Each pipe 76*a*, 76*b*, 76*c*, 76*d* is formed to include a flow passage 86 to conduct regenerative fluid from fuel-fired burner unit 294 to one of regeneration inlets 156.

Filter regenerator 227 includes a regenerative fluid flow router 283 coupled to pipes 76*a*, 76*b*, 76*c*, 76*d* to control which of pipes 76*a*, 76*b*, 76*c*, 76*d* receives regenerative fluid from fuel-fired burner unit 294, as shown in FIGS. 13 and 14. Regenerative fluid flow router 283 includes four valves 280*a*, 280*b*, 280*c*, 280*d* and four valve actuators 282*a*, 282*b*, 282*c*, 282*d*. Each valve actuator 282*a*, 282*b*, 282*c*, 282*d* is coupled to one of valves 280*a*, 280*b*, 280*c*, 280*d* for movement thereof between an opened position allowing flow of regenerative fluid from fuel-fired burner unit 294 and one of passages 86 to one of regeneration inlets 158 and a closed position blocking flow of regenerative fluid from fuel-fired burner unit 294 and one of passages 86 to one of regeneration inlets 158. Thus, each valve 280*a*, 280*b*, 280*c*, 280*d* can be referred to as a regeneration inlet closer and each valve actuator 282*a*, 282*b*, 282*c*, 282*d* can be referred to as a regeneration inlet closer operator. The regeneration inlet closer operator and the filtration inlet closer operator (i e., exhaust gas valve actuators 66*a*, 66*b*, 66*c*, 66*d*) cooperate to provide a closer operator.

Valves 280*a*, 280*b*, 280*c*, 280*d* and valve actuators 282*a*, 282*b*, 282*c*, 282*d* cooperate to provide a regenerative fluid flow router 283. Regenerative fluid flow router 283 and exhaust gas flow router 62 cooperate to provide a flow router 285 configured to regulate flow of regenerative fluid and exhaust gas to regeneration chambers 152*a*, 152*b*, 152*c*, 152*d* and soot filters 122*a*, 122*b*, 122*c*, 122*d*.

Fuel-fired burner unit 294 includes a burner 295, an unheated air supply 296, an air valve 297, an air valve actuator 298, a fuel supply 299, a fuel valve 300, and a fuel valve actuator 301. Burner 295 includes an igniter (not shown) to combust a mixture of air from air supply 296 and fuel from fuel supply 299 to provide regenerative fluid.

Air valve 297 is fluidly interposed between air supply 296 and burner 295. Air valve actuator 298 is coupled to air valve 297 for movement thereof to control the flow rate of the flow of air from air supply 296 to burner 295. Air valve 297 and air valve actuator 298 cooperate to provide a flow rate changer 236.

Fuel valve 300 is fluidly interposed between fuel supply 299 and burner 295. Fuel valve actuator 301 is coupled to fuel valve 300 for movement thereof to control the flow rate of the flow of fuel from fuel supply 299 to burner 295. Fuel valve 300 and fuel valve actuator 301 cooperate to provide a temperature changer 238.

Operation of flow rate changer 236 and temperature changer 238 controls the air-fuel ratio and flow rate of the mixture of air and fuel admitted into burner 295. Operation of flow rate changer 236 and temperature changer 238 thus controls the flow rate and temperature of the regenerative fluid.

Exhaust processor 210 includes a controller 228, as shown in FIG. 14. Controller is configured to control operation of exhaust processor 210. The controller 228 can determine whether soot filters 122*a*, 122*b*, 122*c*, 122*d* have, as a unit, reached their clogging limit based on controller inputs from inlet and outlet pressure sensors 88, 90 that indicate the pressure drop across soot filters 122*a*, 122*b*, 122*c*, 122*d* and other controller inputs such as the engine rpm's 89, the engine torque 94, the turbocharger rpm's 91, the turbo boost pressure 96, and the throttle position 98, as shown in FIG. 14.

If controller 228 determines the clogging limit has been exceeded, controller 228 causes filter regenerator 227 to regenerate only one of soot filters 122*a*, 122*b*, 122*c*, 122*d*. For purposes of explanation, it is assumed that soot filter 122*a* is selected for regeneration.

To regenerate soot filter 122*a*, controller 228 causes exhaust gas valve actuator 66*a* to close exhaust gas valve 164*a* to block exhaust gas from flowing into regeneration chamber 152*a* and through soot filter 122*a* and causes exhaust gas valve actuators 66*b*, 66*c*, 66*d* to open exhaust gas valves 164*b*, 164*c*, 164*d*, to allow exhaust gas to flow into regeneration chambers 152*b*, 152*c*, 152*d* and soot filters 122*b*, 122*c*, 122*d*. Controller 228 causes valve actuator 282*a* to open valve 280*a* allowing a flow of regenerative fluid from burner 295 into regeneration chamber 152*a* and through soot filter 122*a* and causes valve actuators 282*b*, 282*c*, 282*d* to close valves 280*b*, 280*c*, 280*d* blocking a flow of regenerative fluid from burner 295 into regeneration chambers 152*b*, 152*c*, 152*d*.

Controller 228 further operates fuel-fired burner unit 294. Controller 228 operates unheated air supply 296 and fuel supply 299 to provide a flow of air and fuel via air valve 297 and fuel valve 300 to burner 295. Controller 228 causes air valve actuator 298 and fuel valve actuator 301 to move air valve 297 and fuel valve 300 to control the flow rates of the flow of air and fuel to burner 295. Controller 228 causes the igniter of burner 295 to operate in a constant manner during regeneration of soot filter 122*a* to combust the air-fuel mixture in burner 295.

Controller 228 receives an inlet temperature from inlet temperature sensor 92*a*. Controller 228 uses the inlet temperature sensed by inlet temperature sensor 92*a* to determine whether filter regenerator 227 is providing regenerative fluid to soot filter 122*a*.

Controller 228 receives an outlet temperature from outlet temperature sensor 34*a*. Controller 228 uses the outlet temperature sensed by outlet temperature sensor 34*a* in a feedback loop to change the flow rate and temperature of a flow of regenerative fluid to soot filter 122*a* as needed to maintain the outlet temperature at the regeneration temperature during regeneration of soot filter 122*a*. To change the flow rate of the flow of regenerative fluid, controller 228 operates air valve actuator 298 of flow rate changer 236. To change the temperature of the flow of regenerative fluid, controller 228 operates fuel valve actuator 301 of temperature changer 238. Thus, controller 228 provides control means for controlling operation of flow rate changer 236 and temperature changer 238 to change the flow rate and the regenerative fluid temperature in response to the outlet temperature sensed by temperature sensor 34*a* to maintain the outlet temperature at the regeneration temperature during regeneration of soot filter 122*a*.

When controller 228 determines that the particulate matter has been reduced below the clogging limit, controller 228 ceases operation of filter regenerator 227. The igniter of burner 295 is turned off and valve actuator 282*a* closes valve 280*a*. Controller 228 also shuts down any air and fuel pumps dedicated to burner unit 294. Controller 228 further causes exhaust gas valve actuator 66*a* to open exhaust gas valve 164*a* to allow exhaust gas to flow through soot filter 122*a* again.

When controller 228 determines that the clogging limit has been exceeded again, soot filter 122*b* is regenerated. This process is repeated until all soot filters 122*a*, 122*b*, 122*c*, 122*d* have been regenerated to complete one regeneration cycle. After all soot filters 122*a*, 122*b*, 122*c*, 122*d* have been regenerated, the regeneration cycle starts over with soot filter 122*a*. Thus, controller 228 and filter regenerator 227 provide means for sequentially regenerating soot filters 122*a*, 122*b*, 122*c*, 122*d* wherein only one of soot filters 122*a*, 122*b*, 122*c*, 122*d* is regenerated to reduce particulate matter collected in the soot filters 122*a*, 122*b*, 122*c*, 122*d* below the clogging limit each time the particulate matter collected in the soot filters 122*a*, 122*b*, 122*c*, 122*d* exceeds the clogging limit.

What is claimed is:

1. An exhaust processor comprising an emission abatement device including at least two soot filters arranged to lie in parallel relation to one another to collect particulate matter from a flow of unfiltered exhaust gas passed through the soot filters, each soot filter including an inlet end configured to admit unfiltered exhaust gas and an outlet end configured to discharge filtered exhaust gas, an exhaust gas supplier coupled to the emission abatement device and adapted to conduct a flow of unfiltered exhaust gas to the emission abatement device, and a filter regenerator coupled to the emission abatement device and configured to supply a flow of regenerative fluid to the emission abatement device to burn off particulate matter collected in the soot filters included in the emission abatement device, wherein the emission abatement device further includes a regeneration chamber associated with the inlet end of each soot filter, each regeneration chamber includes a flow passage, an outlet configured to discharge fluid from the flow passage into the inlet end of the soot filter associated with said flow passage, a filtration inlet coupled to the exhaust gas supplier and configured to pass unfiltered exhaust gas flowing through the exhaust gas supplier into the flow passage, and a regeneration inlet coupled to the filter regenerator and configured to pass regenerative fluid into the flow passage, and wherein the filter regenerator includes a filtration inlet closer associated with each regeneration chamber and mounted for movement between an opened position allowing flow of unfiltered exhaust gas into the flow passage of the regeneration chamber and a closed position blocking flow of unfiltered exhaust gas into the flow passage of the regeneration chamber, a regeneration inlet closer associated with each regeneration chamber and mounted for movement between an opened position allowing flow of regenerative fluid into the flow passage of the regeneration chamber and a closed position blocking flow of regenerative fluid into the flow passage of the regeneration chamber, and a closer operator configured to move the filtration inlet closer associated with a first of the regeneration chambers to the opened position and the regeneration inlet closer associated with the first of the regeneration chambers to the closed position to allow only unfiltered exhaust gas to flow through the soot filter associated with the first of the regeneration chambers and configured to move the filtration inlet closer associated with a second of the regeneration chambers to the closed position and the regeneration inlet closer associated with the second of the regeneration chambers to the opened position to allow only regenerative fluid to flow through and regenerate the soot filter associated with the second of the regeneration chambers while unfiltered exhaust gas is flowing through and being filtered by the soot filter associated with the first of the regeneration chambers.

2. The exhaust processor of claim 1, wherein the emission abatement device further includes an exhaust gas discharger adapted to be coupled to an exhaust pipe and a housing arranged to interconnect the exhaust gas supplier and the exhaust gas discharger, the housing is formed to include an interior region containing the soot filters in a downstream portion of the housing in close proximity to the exhaust gas discharger, and the regeneration chambers are located in an upstream portion of the interior region of the housing in a position interposed between the exhaust gas supplier and the soot filters.

3. The exhaust processor of claim 2, wherein the housing includes an exterior side wall extending between the exhaust gas supplier and the exhaust gas discharger and the exterior side wall is formed to include the regeneration inlets associated with the regeneration chambers.

4. The exhaust processor of claim 2, wherein the housing includes a pipe associated with each soot filter, each soot filter is contained in one of the pipes, each pipe interconnects the exhaust gas supplier and the exhaust gas discharger, and each pipe includes one of the regeneration chambers and is formed to include one of the regeneration inlets.

5. The exhaust processor of claim 1, wherein the filter regenerator includes an air supply, a first pipe formed to include a passage to conduct air from the air supply to the regeneration inlet of a first of the regeneration chambers, a first heater located in the passage of the first pipe to heat air flowing therethrough, a second pipe formed to include a passage to conduct air from the air supply to the regeneration inlet of a second of the regeneration chambers, and a second heater located in the passage of the second pipe to heat air flowing therethrough.

6. The exhaust processor of claim 5, wherein the emission abatement device further includes a housing containing the regeneration chambers and soot filters, the housing includes a side wall defining the regeneration inlets, the first pipe is coupled to the side wall at a first of the regeneration inlets, and the second pipe is coupled to the side wall at the second of the regeneration inlets.

7. The exhaust processor of claim 5, wherein the regeneration inlet closer associated with the first of the regeneration chambers is configured to provide means for blocking a flow of air in the passage formed in the first pipe through the regeneration inlet of the first of the regeneration chambers and the regeneration inlet closer associated with the second of the regeneration chambers is configured to provide means for blocking a flow of air in the passage formed in the second pipe through the regeneration inlet of the second of the regeneration chambers.

8. The exhaust processor of claim 1, wherein the filter regenerator includes a burner, an air supply configured to supply a flow of air to the burner, an air valve configured to control the flow of air to the burner, a fuel supply configured to supply a flow of fuel to the burner, and a fuel valve configured to control the flow of fuel to the burner, and the burner is configured to combust a mixture of air from the air supply and fuel from the fuel supply to provide the regenerative fluid.

9. The exhaust processor of claim 8, wherein the filter regenerator includes a pipe associated with each regeneration inlet, each pipe is formed to include a passage arranged to conduct regenerative fluid discharged from the burner to the regeneration inlet associated with the pipe, and each regeneration inlet closer is associated with one of the pipes to allow a flow of regenerative fluid from the burner through the passage formed in the one of the pipes to the regeneration inlet associated with the one of the pipes when the regeneration inlet closer is in its opened position and to block a flow of regenerative fluid from the burner through the passage formed in the one of the pipes to the regeneration inlet associated with the one of the pipes when the regeneration inlet closer is in its closed position.

10. The exhaust processor of claim 1, wherein the filtration inlet closer associated with a first of the regeneration chambers includes a valve plate supported for pivotable movement about a pivot axis in the filtration inlet formed in the first regeneration chamber and means for pivoting the valve plate about the pivot axis between a closed position occluding the filtration inlet formed in the first regeneration chamber and an opened position wherein a first portion of the valve plate lies in a flow passage formed in the exhaust gas supplier and a second portion of the valve plate lies in the flow passage formed in the first regeneration chamber to partition the filtration inlet formed in the first regeneration chamber to provide a first flow-conducting passage through the filtration inlet formed in the first regeneration chamber on one side of the valve plate and also provide a second flow-conducting passage through the filtration inlet formed in the first regeneration chamber on an opposite side of the valve plate.

11. The exhaust processor of claim 8, wherein each valve plate has a cross section configured as a quarter section of a circle.

12. An exhaust processor comprising an emission abatement device including at least three soot filters arranged to collect particulate matter from a flow of unfiltered exhaust gas passed through the soot filters, an exhaust gas supplier coupled to the emission abatement device and adapted to conduct a flow of unfiltered exhaust gas to the emission abatement device, and a filter regenerator coupled to the emission abatement device and configured to supply a flow of regenerative fluid to each of the soot filters to burn off particulate matter collected in the soot filters, the filter regenerator including a detector located to communicate with filtered exhaust gas discharged from the soot filters and configured to detect a predetermined characteristic of the filtered exhaust gas associated with onset of occlusion of passages in the soot filters owing to accumulation of particulate matter therein, a regenerative fluid supplier coupled to the emission abatement device and configured to supply a flow of regenerative fluid to the emission abatement device to bum off particulate matter collected in the soot filters, an exhaust gas flow router coupled to the exhaust gas supplier to regulate flow of unfiltered exhaust gas to each soot filter, a regenerative fluid flow router coupled to the regenerative fluid supplier to regulate flow of regenerative fluid to each soot filter, and a regeneration sequencer coupled to the detector, the exhaust gas flow router, and the regenerative fluid flow router and configured to regenerate one soot filter at a time in series using regenerative fluid provided by the regenerative fluid supplier while remaining soot filters operate to receive a flow of unfiltered exhaust gas from the exhaust gas supplier, the regeneration sequencer being programmed to regenerate a first of the soot filters in response to receipt of a first regeneration activation signal generated by the detector, a second of the soot filters in response to receipt of a second regeneration activation signal generated by the detector, and a third of the soot filters in response to receipt of a third regeneration activation signal generated by the detector.

13. The exhaust processor of claim 12, wherein the regeneration sequencer is configured to operate the exhaust gas flow router to allow flow of unfiltered exhaust gas to all soot filters except for one of the soot filters during the entire time that the one of the soot filters is regenerated.

14. The exhaust processor of claim 12, wherein the exhaust gas flow router includes an exhaust gas valve associated with each soot filter and the regeneration sequencer is configured to cause movement of each exhaust gas valve between an opened position allowing flow of unfiltered exhaust gas to the associated soot filter and a closed position blocking flow of unfiltered exhaust gas to the associated soot filter.

15. The exhaust processor of claim 14, wherein the regenerative fluid flow router includes a regenerative fluid valve associated with each soot filter and the regeneration sequencer is configured to cause movement of each regenerative fluid valve between an opened position allowing flow of regenerative fluid to the associated soot filter and a closed position blocking flow of regenerative fluid to the associated soot filter.

16. The exhaust processor of claim 12, wherein the regenerative fluid flow router includes a regenerative fluid valve associated with each soot filter and the regeneration sequencer is configured to cause movement of each regenerative fluid valve between an opened position allowing flow of regenerative fluid to the associated soot filter and a closed position blocking flow of regenerative fluid to the associated soot filter.

17. An exhaust processor comprising an emission abatement device including a soot filter arranged to collect particulate matter from a flow of unfiltered exhaust gas passed through the soot filter, an exhaust gas supplier coupled to the emission abatement device and adapted to conduct a flow of unfiltered exhaust gas to the emission abatement device, a filter regenerator coupled to the emission abatement device and configured to supply a flow of regenerative fluid to the soot filter to burn off particulate matter collected in the soot filter, the filter regenerator including a temperature sensor positioned to lie in thermal communication with an outlet end of the soot filter and configured to sense an outlet temperature associated with the outlet end, a pipe formed to include a passage to conduct regenerative fluid to the soot filter, a flow rate changer associated with the pipe and configured to change the flow rate of regenerative fluid flowing therethrough to reach the soot filter, and a temperature changer associated with the pipe and configured to change the temperature of regenerative fluid flowing therethrough to reach the soot filter, and a controller coupled to each of the flow rate changer and the temperature changer and temperature sensor and configured to operate the flow rate changer and the temperature changer to cause a change in at least one of the flow rate and temperature of the regenerative fluid flowing through the pipe to reach the soot filter in response to the outlet temperature sensed by the temperature sensor to maintain the outlet temperature at a regeneration temperature during regeneration of the soot filter.

18. The exhaust processor of claim 17, wherein the filter regenerator includes an air supply, the flow rate changer includes a valve positioned to change the flow rate of a flow of air from the air supply, the temperature changer includes an electric heater positioned to change the temperature of the flow of air from the air supply, and the controller is coupled to the valve and the electric heater and is configured to control operation of the valve and the electric heater in response to the outlet temperature sensed by the temperature sensor.

19. The exhaust processor of claim 18, wherein the electric heater is positioned in the passage.

20. The exhaust processor of claim 17, wherein the filter regenerator includes a burner, an air supply, and a fuel supply, the flow rate changer includes an air valve configured to control a flow of air from the air source to the burner, the temperature changer includes a fuel valve configured to control a flow of fuel from the fuel source to the burner, the burner is configured to combust a mixture of air received from the air source via the air valve and fuel received from the fuel source via the fuel valve to provide the regenerative fluid, and the controller is coupled to the air valve and the fuel valve and configured to control operation of the air valve and the fuel valve in response to the outlet temperature sensed by the temperature sensor.

* * * * *